US005618013A

United States Patent [19]

Mugg

[11] Patent Number: 5,618,013

[45] Date of Patent: Apr. 8, 1997

[54] MOVABLE POINT FOR A CROSSING FROG FOR RAILWAY APPARATUS OF VERY GREAT LENGTH, INCORPORATED IN LONG WELDED RAILS

[75] Inventor: Philippe Mugg, Haguenau, France

[73] Assignee: Cogifer- Compagnie Generale d'Installations Ferroviaires (Societe Anonyme a Directoire), Croissy Sur Seine, France

[21] Appl. No.: 614,652

[22] Filed: Mar. 13, 1996

[30] Foreign Application Priority Data

Aug. 10, 1995 [FR] France ..... 95 09811

[51] Int. Cl.[6] ..... E01B 7/00

[52] U.S. Cl. ..... 246/385; 246/472; 246/442

[58] Field of Search ..... 246/385, 388, 246/415 R, 454, 460, 464, 468, 472, 442

[56] References Cited

U.S. PATENT DOCUMENTS

| | | | |
|---|---|---|---|
| 859,101 | 7/1907 | Odenkirk et al. | 246/385 |
| 3,766,770 | 10/1973 | Sato et al. | 246/468 |
| 3,787,680 | 1/1974 | Perrot | 246/468 |
| 4,824,055 | 4/1989 | Tuningley et al. | 246/458 |
| 5,082,214 | 1/1992 | Testart | 246/385 |
| 5,336,184 | 11/1994 | Testart et al. | 246/385 |

FOREIGN PATENT DOCUMENTS

| | | |
|---|---|---|
| 0365450 | 4/1990 | European Pat. Off. . |
| 2142574 | 2/1973 | France . |
| 2695662 | 3/1994 | France . |
| 481267 | 12/1969 | Switzerland . |

*Primary Examiner*—S. Joseph Morano
*Attorney, Agent, or Firm*—Young & Thompson

[57] ABSTRACT

A movable point for a crossing frog for railway apparatus of great length, incorporated in long welded rails. The point (7) is comprised of a single steel element, which comprises integral seating cross members (8). The rigidity of the point varies along all its length from a minimum adjacent a thin forward portion (9) to a maximum adjacent a wide rear portion (10). The point is constituted by a piece of austenitic manganese steel. The point can be of cast steel or can be formed by laminating and/or forging, followed by machining.

8 Claims, 4 Drawing Sheets

MOVABLE POINT FOR A CROSSING FROG FOR RAILWAY APPARATUS OF VERY GREAT LENGTH, INCORPORATED IN LONG WELDED RAILS

The present invention relates to the field of construction of railway equipment, particularly crossing frogs, and has for its object a movable point for a crossing frog for railway apparatus of very great length, incorporated in long welded rails, said point comprising moreover arrangements to carry out its seating.

This type of crossing frog is known and its construction is described, particularly in U.S. Pat. No. 5,133,522. Moreover, U.S. Pat. No. 5,366,184 discloses the anchoring of such a crossing frog, which comprises a fixed portion, a cradle, and a movable portion, namely, the movable point.

According to this known construction, the movable point is comprised of rails machined and assembled and anchored at its heel in one of the elements of the cradle.

Figure 1:
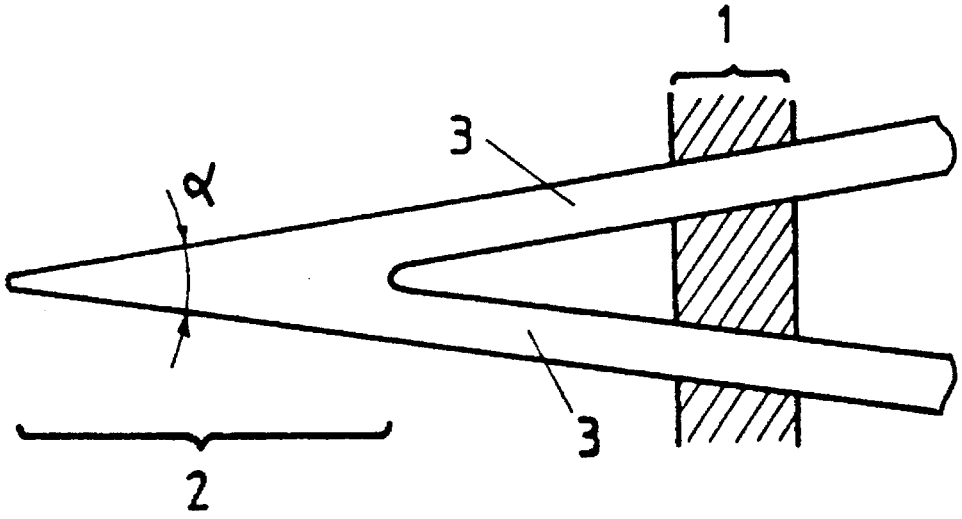
FIG. 1 PRIOR ART

Other constructions of the point are known and are generally constituted, as shown in FIG. 1 of the accompanying drawings, by a movable region located in front of the seat 1 and comprising two portions, namely a first portion 2, of substantially triangular shape, and a second portion 3 of two elements shaped as a rail profile. Such a point can be completely cast or comprised by three elements welded together.

In these known embodiments, the angle $\alpha$ of the point is relatively great and requires such a configuration. But when the angle $\alpha$ is very small, the length of the assembly thus constituted becomes uselessly great, such that the movable region is practically limited to its triangular portion.

Figure 2A:
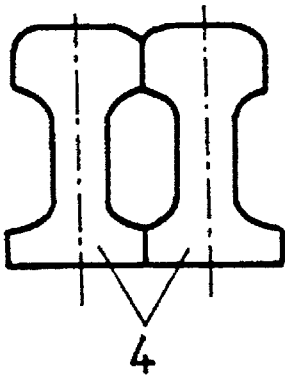
FIG. 2A PRIOR ART
Figure 2B:
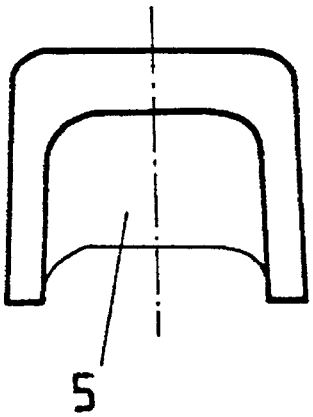
FIG. 2B PRIOR ART
Figure 2C:
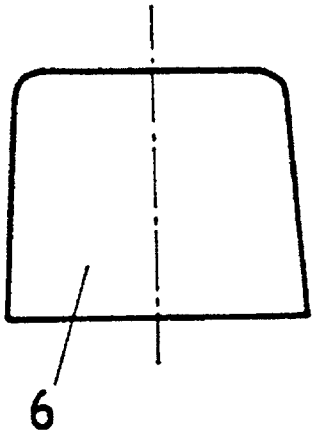
FIG. 2C PRIOR ART

To this end, FIGS. 2*a*, 2*b*, and 2*c* of the accompanying drawings show at the different known possible cross sections of the movable region, namely, at FIG. 2*a*, in the form of two rail profiles 4, at FIG. 2*b* in the form of a cast member 5 and, at FIG. 2*c*, in the form of a monoblock member 6.

Such sections have a high transverse moment of inertia which, on the one hand, involves large flexure forces, and on the other hand, does not permit adjustment of the curve of deformation of the point. Moreover, the construction of the seating requires a large number of pieces to connect the constituent elements of the point to the cradle.

The problem to be solved by the present invention is therefore to design and produce a movable point of a crossing frog which does not have these drawbacks.

To this end, the invention has for its object a movable point for a crossing frog for railway apparatus of very great length, incorporated in long welded rails, said point being comprised of a single steel element, characterized in that there are integrated therewith seating cross members and in that its rigidity is variable along all its length from a minimum adjacent its forward slender point, to a maximum at its wide rear.

Figure 3:
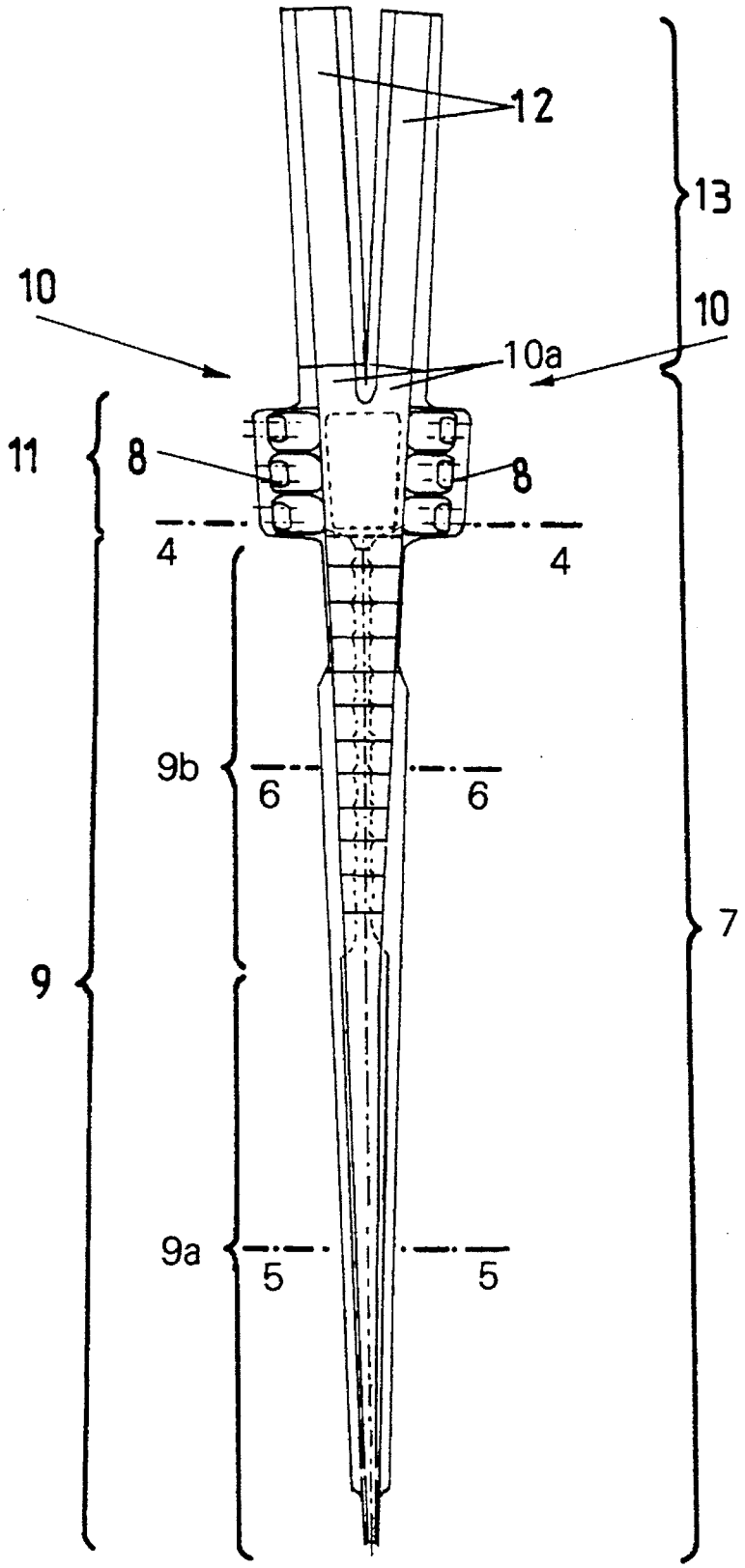
Figure 4:
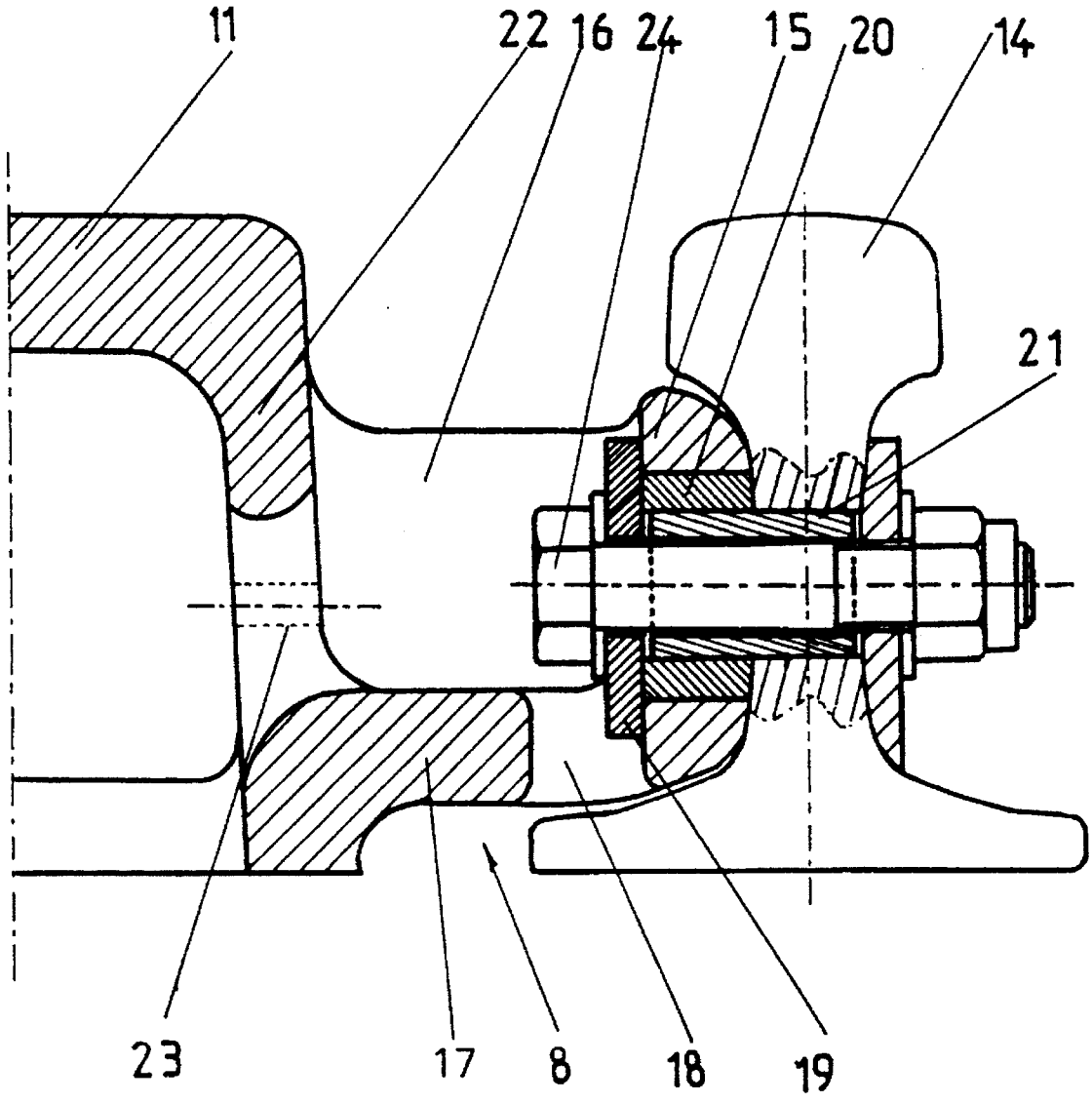
Figure 5:
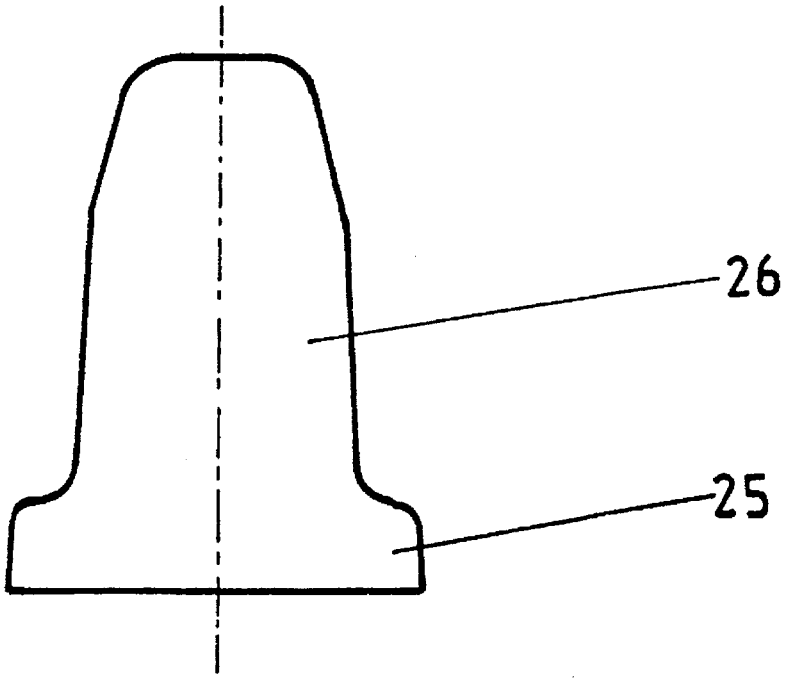
Figure 6:
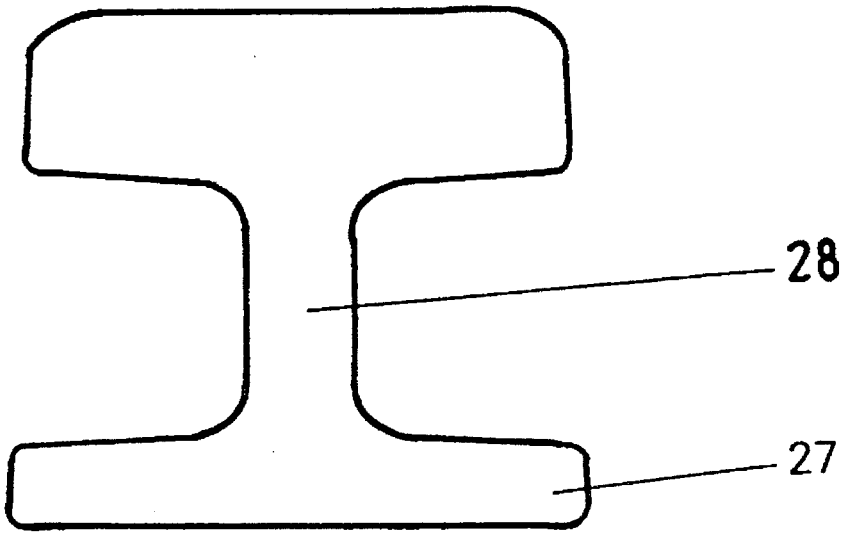

The invention will be better understood from the description hereafter, which relates to a preferred embodiment, given by way of non-limiting example, and explained with reference to the accompanying schematic drawings, in which:

FIG. 1 is a plan view of a mobile point of crossing frog of known type;

FIGS. 2*a* to 2*c* are cross-sectional views of various known modes of construction of the point;

FIG. 3 is a plan view of a movable point according to the invention;

FIG. 4 is a half view in cross section on the line 4—4 of FIG. 3, of a seating cross member, and FIGS. 5 and 6 are cross-sectional views of the movable point according to the invention, respectively on the lines 5—5 and 6—6 of FIG. 3.

According to the invention and as shown more particularly by way of example in FIG. 3 of the accompanying drawings, the movable point 7 for a crossing frog for railway apparatus of very great length, incorporated in long welded rails, which is produced from a single steel element, combines integrally seating cross members 8 and its rigidity is variable along all its length from a minimum adjacent its flexible forward portion 9, to a maximum at its wide rear portion 10.

The movable point 7 is essentially constituted by one piece, preferably of austenitic manganese steel and comprises a flexible forward portion 9, an inflexible central portion 11, bearing seating cross members 8, and a wide rear portion 10 constituted by two elements 10*a*, to which are welded two rails 12 forming a portion 13, the elements 10*a* of the cast portion 7 matching the profile of the corresponding rails 12.

According to one characteristic of the invention, the movable point 7 is preferably one cast piece.

It is also possible to produce the movable point 7, according to another characteristic of the invention, by lamination and/or forging, followed by machining.

The flexible forward portion 9 comprises two regions of different cross section, whose general shape is that of an inverted T at its slender end 9*a* and of a I in its wider portion 9*b* connected to this slender end 9*a*.

According to one characteristic of the invention and as shown in FIG. 4, the inflexible central portion 11 has a hollowed cross section.

The seating cross members 8, of which one is represented in detail in FIG. 4 of the accompanying drawings, are present in the form of points of securement to a cradle 14 and are provided on opposite sides of the inflexible central portion 11.

Each cross member 8 comprises, on the one hand, at its end coacting with the cradle 14, a vertical plate 15 for bearing against the web of the cradle 14 and, on the other hand, vertical ribs 16 and a horizontal rib 17 for connection of each vertical plate 15 to the inflexible central portion 11 of the movable point 7.

Each horizontal rib 17 is provided, in line with the vertical plate 15 for bearing against the web of the cradle 14, with a recess 18 for the passage of a spacer ring 19.

Moreover, according to another characteristic of the invention, each vertical plate 15 for bearing against the web of the cradle 14 is provided with a metallic insert 20 of unalloyed steel, integrated into the plate at the moment of casting or mounting in this latter by force or welding. Such an insert permits obtaining a precise machining of the hole receiving a resilient pin 21.

Finally, according to another characteristic of the invention, the vertical wall 22 of the inflexible central portion 11 of the movable point 7 is provided, in line with each cross member 8, with a recess 23 permitting the passage of the head of a bolt 24 for securement to the cradle 14, at the time of its emplacement.

To ensure its emplacement on the cradle 14 and to limit the flexural forces, the movable point 7 should have certain characteristics of design seemingly incompatible, namely, it must be rigid in its slender end portion 9*a*, and flexible in its wider portion 9*b*. Such criteria can be satisfied by the inverted T shape of the portion 9*a* and the I shape of the wide portion 9*b*, as shown in FIGS. 5 and 6.

As shown more particularly in FIG. 5, the rigidity of the slender portion 9*b* is obtained by widening or thickening the foot 25 and by thickening the web 26. On the contrary, in its wide portion 9" (FIG. 6), the foot 27 as well as the web 28 are thinned, and, in the portion nearest the seating, the width of the foot is reduced.

Modern CAO means permit easily determining the optimum dimensions of the movable point 7 according to the invention. To this end, a first computation is effected, permitting finding the moment of inertia of the various sections, to then calculate the curve of deformation of the point. According to the spacing from the desired curve, the parameters of the sections are modified and the computations are repeated. By successive approaches, the difference from the desired values is reduced. The deformation of the member is then effected to determine the stress distribution by structural computation. According to the results obtained, for example if it is determined that the stress concentrations are abnormal, the procedure is repeated to obtain an optimum result.

The movable point thus obtained can preferably be subjected to a cold peening operation by various known techniques, before placing it in service. The connection with the end rails is effected by welding according to known procedures, these rails being steel which has been treated or not.

Of course, the invention is not limited to the embodiment described and shown in the accompanying drawings. Modifications remain possible, particularly as to the construction of the various elements or by substitution of technical equivalents, without thereby departing from the scope of protection of the invention.

I claim:

1. A movable point for a crossing frog for a railway apparatus of great length, incorporated in long welded rails, said point (7) being comprised by a single steel member cast in one piece, comprising a front triangular portion (7) a central portion (11) and a rear portion (10) constituted of two rearwardly extending elements (10*a*) to which are welded two rails (12), said elements (10*a*) of the point (7) being shaped to the profile of the corresponding rail (12), only the front triangular portion (9) being flexible and the central portion (11) having integral laterally extending members (8) for securement of said central portion within a cradle (14).

2. A movable point according to claim 1, wherein said flexible portion (9) comprises two regions of different cross-section, comprising one of inverted T-shape at its forward end (9*a*) and one of I-shaped cross-section in a wider rear portion (9*b*).

3. A movable point according to claim 1, wherein said central portion (11) has a hollow cross-section.

4. A movable point according to claim 1, which is of manganese austenitic steel.

5. A movable point according to claim 1, wherein each said laterally extending member (8) comprises, at an outer end secured to said cradle (14), a vertical plate (15) that bears against a web of said cradle (14) and vertical ribs (16) and a horizontal rib (17) for connecting said vertical plate (15) to said central portion (11) of the movable point (7).

6. A movable point according to claim 5, wherein each said horizontal rib (17) is provided in line with the vertical plate (15) with a recess (18) for passage of a spacing ring (19).

7. A movable point according to claim 5, wherein each said vertical plate (15) is provided with a metallic insert (20) of nonalloy steel, integrated into the plate (15).

8. A movable point according to claim 3, wherein a vertical wall (22) of said central portion (11) of the movable point (7) is provided, in line with each said laterally extending member (8), a recess (23) permitting the passage of the head of a bolt (24) for securement to said cradle (14).

* * * * *